US006050341A

United States Patent [19]

Metcalf

[11] Patent Number: 6,050,341

[45] Date of Patent: Apr. 18, 2000

[54] DOWNHOLE RUNNING TOOL

[75] Inventor: Paul David Metcalf, Peterculter, United Kingdom

[73] Assignee: Petroline Wellsystems Limited, Aberdeen, United Kingdom

[21] Appl. No.: 08/988,532

[22] Filed: Dec. 10, 1997

[30] Foreign Application Priority Data

Dec. 13, 1996 [GB] United Kingdom ..... 9625937

[51] Int. Cl.[7] ..... E21B 23/08

[52] U.S. Cl. ..... 166/383; 166/383; 166/207; 166/333.1; 166/334.1; 166/240

[58] Field of Search ..... 166/383, 207, 166/333.1, 334.1, 240

[56] References Cited

U.S. PATENT DOCUMENTS 3,669,190 6/1972 Sizer et al. ..... 166/207
4,273,372 6/1981 Sheshtawy .
4,913,229 4/1990 Hearn .
5,170,847 12/1992 Mims et al. ..... 166/383
5,180,010 1/1993 Stout et al. .
5,580,114 12/1996 Palmer .

FOREIGN PATENT DOCUMENTS 0976020 11/1982 U.S.S.R. ..... 166/207

*Primary Examiner*—William Neuder
*Attorney, Agent, or Firm*—Alston & Bird LLP

[57] ABSTRACT

A downhole running tool (10) for use in positioning an item, such as a length of tubing (12) , in a bore comprises a body (11, 22) defining a fluid passage, an arrangement (20, 30) for creating a flow restriction, to create an increase in fluid pressure in the passage, and a fluid actuated retaining member (34) mounted on the body for engaging an item (12) to be carried into a bore on the tool (10). The retaining member (34) is in fluid communication with the body fluid passage above the flow restriction arrangement (20, 30) and is movable to a retracted position to release the item (12) by application of fluid pressure forces.

16 Claims, 1 Drawing Sheet

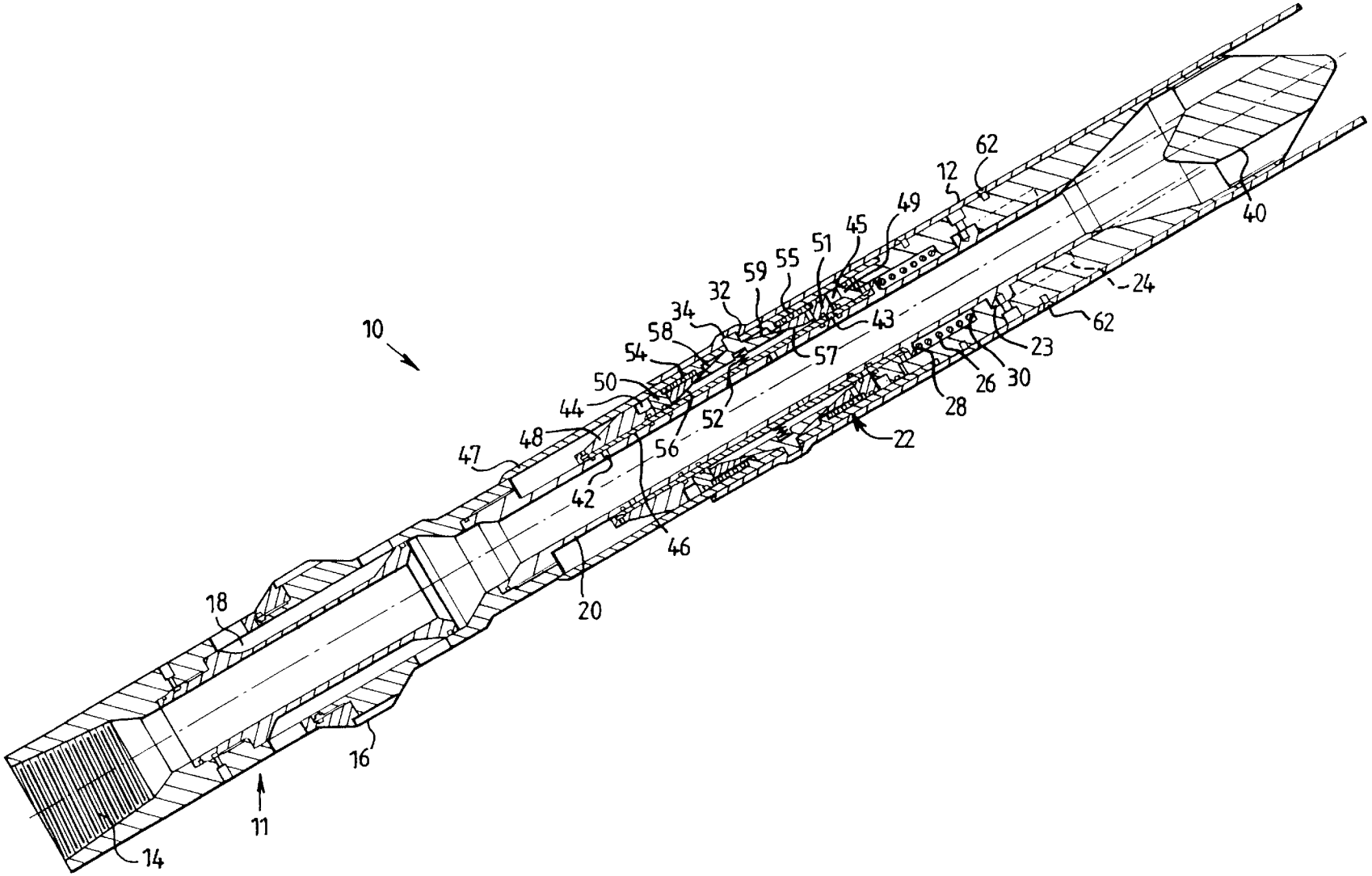
40
24
62
23
30
26
28
22
62
12
49
43
45
51
57
55
59
32
52
34
58
56
54
46
50
42
44
20
48
47
10
16
11
18
14

DOWNHOLE RUNNING TOOL

FIELD OF THE INVENTION

This invention relates to a downhole running tool, and in particular but not exclusively, to a tool for use in running a length of expandable tubing into a drilled bore.

BACKGROUND OF THE INVENTION

WO-A-93\25800 (Shell Internationale Research) discloses a method of completing an uncased section of a borehole in an underground formation. A liner provided with overlapping longitudinal slots is fixed at a predetermined position in the borehole. A tapered expansion mandrel having a maximum diameter which is of larger diameter than the liner is moved through the liner and expands the liner to a diameter larger than the mandrel maximum diameter. Ideally, the liner is expanded to such an extent that it contacts the borewall.

It is among the objectives of embodiments of the present invention to provide a tool which may be utilised to run a length of expandable liner into a bore, release the liner, and then expand the liner.

SUMMARY OF THE INVENTION

According to the present invention there is provided a downhole running tool for use in positioning an item in a bore, the tool comprising:

a body defining a fluid passage therethrough;

means for creating a flow restriction, to create an increase in fluid pressure in the passage; and a fluid actuated retaining member mounted on the body for engaging an item to be carried into a bore on the tool, the retaining member being in fluid communication with the body fluid passage above the flow restriction means and being movable to a retracted position to release the item by application of fluid pressure forces thereto.

According to another aspect of the present invention there is provided a method of positioning an item in a bore, the method comprising the steps:

(a) providing a downhole running tool comprising a body defining a fluid passage therethrough and having a fluid actuated retaining member mounted thereon and in fluid communication with the passage, the retaining member being movable between extended and retracted positions by application of fluid pressure forces thereto;

(b) mounting an item to be carried into a bore on the tool and engaging the item with the extended retaining member;

(c) running the tool and item into a bore;

(d) creating a flow restriction in or below the passage;

(e) increasing the fluid pressure in the passage to move the retaining member to the retracted position and release the item from the tool; and (f) retrieving the tool from the bore.

The present invention therefore permits release of the item from the running tool on application of fluid pressure forces to the retaining member. This minimises the possibility of premature or accidental release of the item from the running tool, as may occur with items retained on running tools solely by shear pins and the like.

The invention is useful for locating expandable tubing, particularly longitudinally slotted tubing as described in WO-A-93\25800, in a bore, though of course the invention may be used in many other applications.

Preferably, the tool is provided in combination with means defining a profile for cooperation with the retaining member.

Preferably also, the means for creating a flow restriction is movable between a non-restricting position and a restricting position, and may be moved to the restricting position on the tool and item reaching the desired location in the bore. This further minimises the possibility of an accidental release of the item. The flow restriction means may include an axially movable sealing member which is movable to close or restrict the passage, and in a preferred embodiment the member is in the form of a sleeve which is movable to engage and close an orifice insert in the passage. The axially movable sealing member is preferably initially retained in a non-restricting position relative to the body, and most preferably is retained by a J-slot arrangement, such that the member may be released by manipulation of the string. Most preferably, the sealing member is connected to the string such that on release of the member from the body the weight of the string acts to move the member to the restricting position. Alternatively, or in addition, the sealing member may be biassed towards the restricting position.

In other embodiments the means for creating a flow restriction may take other forms, such as a venturi, an orifice plate, or a restriction for catching a ball.

Preferably also, the fluid actuated retaining member includes a keying member normally biassed towards an extended position. Most preferably, the fluid actuated retaining member further comprises an axially movable floating piston which is movable on application of fluid pressure forces thereto, the piston defining a cam surface for engaging a corresponding surface on a portion of the keying member, whereby axial movement of the piston relative to the keying member results in retraction of the keying member. In a preferred embodiment, two floating pistons are provided, one above and one below the keying member, and on application of fluid pressure forces thereto the pistons move towards one another to retract the keying member. Typically, two or more keying members will be provided, circumferentially spaced around the tool.

The tool may be provided with additional releasable retaining members, such as shear pins.

Preferably also, when intended for use in conjunction with expandable tubing, the tool defines an expansion profile so that the tool may be pushed or pulled through the tubing to expand the tubing to the desired diameter.

According to a further aspect of the present invention there is provided a downhole running tool for use in positioning expandable tubing in a bore, the tool comprising:

a body for mounting on a string and defining a fluid passage therethrough including means for creating a flow restriction therein, to create an increase in fluid pressure in the passage;

a normally extended fluid actuated retaining member mounted on the body for engaging a section of expandable tubing, the retaining member being in fluid communication with the body passage and being movable to a retracted position to release the tubing by application of fluid pressure forces thereto; and an expander cone mounted on the body, for expanding the released tubing.

BRIEF DESCRIPTION OF THE DRAWING

These and other aspects of the present invention will now be described, by way of example, with reference to the accompanying drawing, which illustrates a downhole running tool in accordance with a preferred embodiment of the present invention.

DETAILED DESCRIPTION OF THE DRAWING

The drawing illustrates a tool 10 for use in locating a length of expandable tubing 12 in a borehole, and then expanding the tubing 12 to a desired expanded diameter.

The tool 10 has a tubular upper body portion 11 which defines a conventional box connection 14 for attaching to the lower end of a drillstring (not shown). Below the connection 14 is an expansion cone 16 and, to permit passage of fluid past the cone 16, bypass passages 18 extend beneath the cone 16. Extending from the lower end of the upper body portion 11 is a sleeve 20 on which a tool lower body portion 22 is mounted, via J-slot lugs 23 and J-slots 24 on the body. A compression spring 26 is located between a sleeve shoulder 28 and a body shoulder 30 and tends to urge the sleeve 20 downwardly relative to the lower body portion 22. The upper end of the tubing 12 defines a profile 32 which engages a number of keying members 34 spring biassed to extend outwardly of the tool body.

The drawing illustrates the tool 10 and tubing 12 ready for running in to a bore. On the tool and tubing reaching the desired location within the bore, and the lower end of the tubing engaging the bore end wall, the drillstring and tool upper body portion 11 are rotated relative to the tubing 12 and the tool lower body portion 22. The rotation moves the J-slot lugs 23 into the longer legs of the respective J-slots 24, such that the sleeve 20 may move downwardly relative to the lower body portion 22, bringing the sleeve end into engagement with a central portion of an orifice element 40 provided at the lower end of the body portion 22 (lower sleeve position shown in ghost outline). This has the effect of sealing the lower end of the tool throughbore. Accordingly, pumping fluid from the surface through the drillstring and into the tool 10 will now result in an increase in fluid pressure within the tool 10. This fluid pressure is communicated through the sleeve 20, via upper and lower sleeve ports 42, 43, into respective upper and lower annular piston chambers 44, 45.

The chambers piston 44, 45 are defined by inner and outer cylindrical sleeves 46, 47, upper and lower annular fixed pistons 48, 49, and respective upper and lower annular floating pistons 50, 51. An inner portion of each keying member 34 is positioned between the floating pistons 50, 51, a coil spring 52 being provided between each keying member 34 and the inner sleeve 46 to normally bias the members 34 outwardly into engagement with the tubing profile 32, and further springs 54, 55 being provided to bias the pistons 5O, 51 apart. Each floating piston 50, 51 defines a sloping cam face 56, 57 for engaging a corresponding face 58, 59 on the keying members 34. Accordingly, an increase in fluid pressure within the tool 10 tends to push the floating pistons 50, 51 towards one another, and retract the keying members 34.

Once the keying members 34 have been retracted, out of engagement with the profile 32, a light jar will shear the pins 62 extending between the lower body portion 22 and the upper end of the tubing 12, and the tool 10 may then be pushed downwardly through the tubing 12 with the cone 16 expanding the tubing to the desired diameter.

It will be clear from the above description that the tool 10 permits a section of tubing 12 to be securely but releasably located on the tool 10 until the tubing 12 has reached the desired location. The sequence of rotation and then pressuring up make it most unlikely that the tubing 12 will be inadvertently or accidentally released from the tool 10.

It will be clear to those of skill in the art that the above-described tool is merely exemplary of the present invention, and that various modifications and improvements may be made thereto without departing from the scope of the invention. It will also be evident that the use of the invention is not limited to deployment of tubing, and embodiments of the invention may be utilised in a wide range of applications.

I claim:

1. A downhole running tool for use in positioning an item in a bore, the tool comprising:

a body defining a fluid passage;

means for creating a flow restriction, to create an increase in fluid pressure in the passage; and a fluid actuated retaining member mounted on the body for engaging said item to be carried into said bore on the tool, the retaining member being in fluid communication with the body fluid passage above the flow restriction means and being movable to a retracted position to release the item by application of fluid pressure forces thereto.

2. The tool of claim 1, wherein said item is a length of expandable tubing.

3. The tool of claim 1, wherein said item includes means defining a profile for co-operation with the retaining member.

4. The tool of claim 1, wherein the means for creating a flow restriction is movable between a non-restricting position and a restricting position.

5. The tool of claim 4, wherein the flow restriction means includes an axially movable sealing member which is movable to at least restrict flow through the fluid passage.

6. The tool of claim 5, wherein the axially movable sealing member is a sleeve which is movable to engage and close an orifice insert in the fluid passage.

7. The tool of claim 6, wherein the axially movable sealing member is initially retained in a non-restricting position relative to the body.

8. The tool of claim 7, wherein the axially movable sealing member is retained by a J-slot arrangement, such that the sealing member may be released by manipulation of a tool mounting string.

9. The tool of claim 5, wherein the sealing member is adapted to be connected to a tool mounting string such that on release of the sealing member from the body the weight of the string acts to move the sealing member to the restricting position.

10. The tool of claim 1, wherein the fluid actuated retaining member includes a keying member normally biassed towards an extended position.

11. The tool of claim 10, wherein the fluid actuated retaining member further comprises an axially movable floating piston which is movable on application of fluid pressure forces thereto, the piston defining a cam surface for engaging a corresponding surface on a portion of the keying member, whereby axial movement of the piston relative to the keying member results in retraction of the keying member.

12. The tool of claim 11, wherein two floating pistons are provided, one above and one below the keying member, and on application of fluid pressure forces thereto the pistons move towards one another to retract the keying member.

13. The tool of claim 12, wherein a plurality of keying members are provided and are circumferentially spaced around the tool.

14. The tool of claim 1, wherein the tool defines an expansion profile so that the tool may be moved through expandable tubing to expand the tubing to a larger diameter.

15. A downhole running tool for use in positioning expandable tubing in a bore, the tool comprising:

a body for mounting on a string and defining a fluid passage therethrough including means for creating a flow restriction therein, to create an increase in fluid pressure in the passage;

a normally extended fluid actuated retaining member mounted on the body for engaging a section of said expandable tubing, the retaining member being in fluid communication with the body passage and being movable to a retracted position to release the expandable tubing by application of fluid pressure forces thereto; and an expander cone mounted on the body, for expanding the released expandable tubing.

16. A method of positioning an item in a bore, the method comprising the steps:

(a) providing a downhole running tool comprising a body defining a fluid passage therethrough and having a fluid actuated retaining member mounted thereon and in fluid communication with the passage, the retaining member being movable between extended and retracted positions by application of fluid pressure forces thereto;

(b) mounting said item to be carried into a bore on the tool and engaging the item with the extended retaining member;

(c) running the tool and item into a bore;

(d) creating a flow restriction in the passage;

(e) increasing the fluid pressure in the fluid passage to move the retaining member to the retracted position and release the item from the tool; and (f) retrieving the tool from the bore.

* * * * *